United States Patent [19]

Sato

[11] Patent Number: 4,653,756

[45] Date of Patent: Mar. 31, 1987

[54] GOLF CLUB IRON

[75] Inventor: Koji Sato, Tokyo, Japan

[73] Assignee: Daiwa Golf Co., Ltd., Tokyo, Japan

[21] Appl. No.: 791,207

[22] Filed: Oct. 25, 1985

[51] Int. Cl.[4] ..... A63B 53/04

[52] U.S. Cl. ..... 273/167 E; 273/169; 273/171; 273/194 A

[58] Field of Search ..... 273/162 R, 162 F, 167 E, 273/167 J; D21/214, 215, 216, 217, 218, 219, 220, 169, 170, 171, 172, 173, 174, 175, 194 A, 186 A

[56] References Cited

U.S. PATENT DOCUMENTS 1,690,388 11/1928 Waldron ..... 273/167 E X 3,976,299 8/1976 Lawrence et al. ..... 273/167 E X

*Primary Examiner*—George J. Marlo

*Attorney, Agent, or Firm*—Kalish & Gilster

[57] ABSTRACT

A metal golf club head comprising a face portion, a wing extending from the upper end of said face portion rearwardly thereof. The upper surface of said wing is contoured for coincidence with the radial trajectory of the golf club head during down swinging thereof. A toe portion extends rearwardly from the outer end of the face portion, a sole portion extends rearwardly from the lower end of said head with there being a rearwardly opening recess in said club head defined by the wing, sole portion, toe portion, rearward surface of said face portion and a heel portion at the inner end of said face portion. Said wing and said toe portion may be constructed independently of said head and secured to the face portion thereof as by suitable fasteners.

9 Claims, 14 Drawing Figures

GOLF CLUB IRON

BACKGROUND AND SUMMARY OF THE INVENTION

The present invention relates to heads for iron golf clubs (as distinguished from the so-called "woods") and, more particularly, to an iron golf club head designed to relatively reduce the influence of air flow on the head during the stroke downswing.

Conventional iron golf club heads will first be described with reference to FIG. 1 wherein 1 indicates a club head body made of metal and being comprised of a face portion 2 having an inclination corresponding to the loft angle relating to the particular iron club member, a top portion 3 above face portion 2, a sole portion 4 extending rearwardly from the lower margin of face portion 2, a toe portion 5, a heel portion 6 on either lateral end of face portion 2, and a neck portion (hosel) 7 extending obliquely upwardly from heel portion 6.

With the conventional iron golf club head as above described, when the downswing is performed descending from the top position, the air flow passing by top portion 3 of head body 1 streams into the side of a back portion 8 of said body 1 and produces a plurality of vortex flow, which act largely on said head body 1 to cause an aerodynamic reaction. As a result, the swing speed of the club head drops, the trajectory of the head fluctuates to render unsuitable the posture of the club head relative to the ball and the direction of the club head face portion 2 with respect to the desired course of flight of the ball. Additionally, the impact point on the golf club face portion 2 with the ball deviates from a requisite contact point thereby increasing the possibility of causing a faulty or imperfect shot, resulting in substantial failure to increase the travel distance of the ball. These disadvantages are peculiar to iron clubs of lower iron number.

Furthermore, with the iron golf club head as above described, adjustment of toe-heel balance, particularly of the weight balance between top and sole, is scarcely attainable.

The present invention has solved the foregoing problems of the prior art. Thus, the primary object thereof is to provide an iron golf club head which eliminates the posture and direction of the head thereby reducing the potential for a faulty or imperfect shot.

Another object of the present invention is to provide an iron golf club head of the character stated which conduces to facile adjustment of toe-heel balance and top-sole balance of the golf club head.

To achieve the foregoing objects, an iron golf club head according to the present invention includes a wing for suppression of fluctuation provided at a top portion of the golf club head which extends rearwardly thereof and coincides with the radial trajectory of the head during the stroke downswing.

DESCRIPTION OF PRACTICAL EMBODIMENTS

Figure 1:
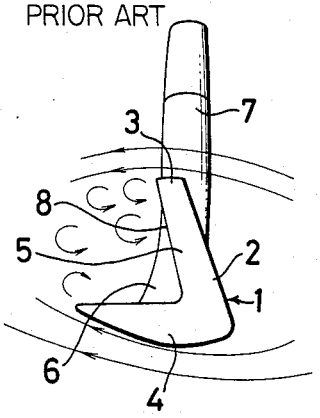
FIG.1 PRIOR ART
FIG. 1 is a side view of a conventional iron golf club head.
Figure 2:
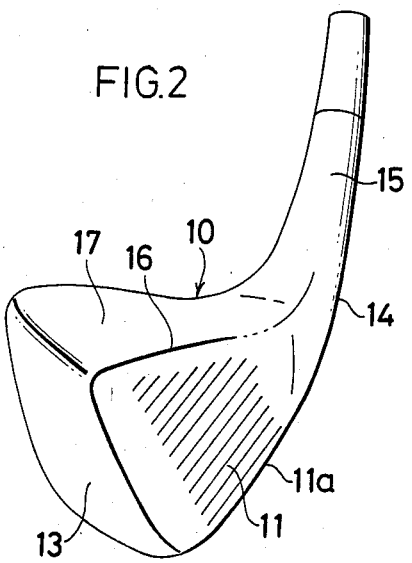
FIG. 2 is a perspective view of an iron golf club head constructed in accordance with and embodying the present invention.
Figure 3:
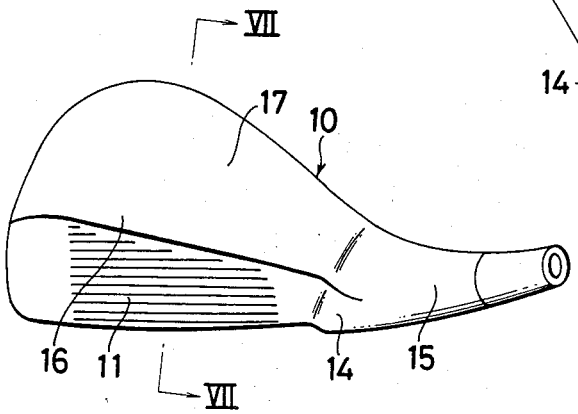
FIG. 3 is a top plan view.
Figure 4:
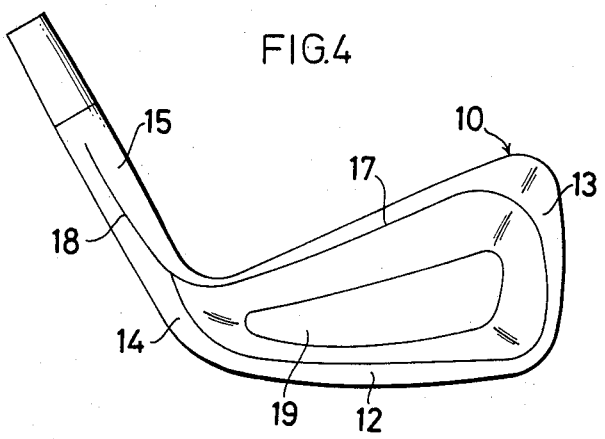
FIG. 4 is a rear elevational view.
Figure 5:
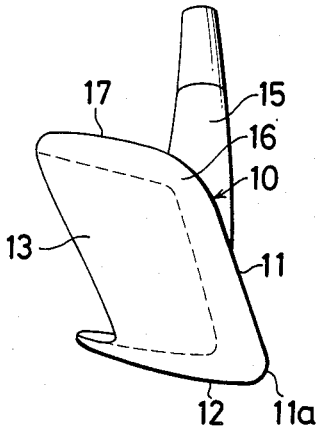
FIG. 5 is an end elevational view of the outer end of the head, that is, when viewed from the toe side.
Figure 6:
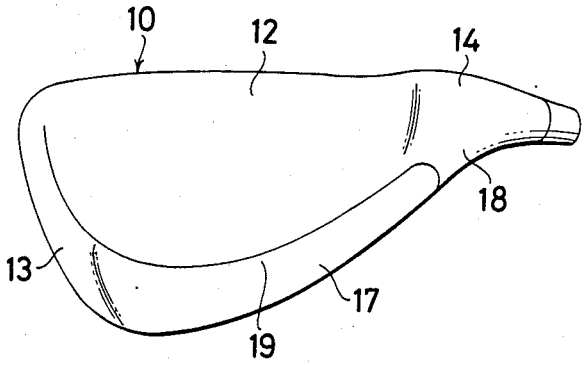
FIG. 6 is a bottom plan view.

The present invention will be initially described in connection with the embodiment illustrated in FIGS. 2–7, inclusive, in which reference numeral 10 indicates a golf club head body integrally formed of metal, such as stainless steel, soft iron, brass or aluminum, and is composed of a face portion 11 having an inclination corresponding to the loft angle of the related club, a blade or wing-like sole portion 12 extending rearwardly from a lower margin 11*a* of face portion 11 and constituting a lower wing, a toe portion 13 extending rearwardly from the outer end of face portion 11, and heel portion 14 provided at the inner end of face portion 11, said heel portion 14 being formed integrally with a neck portion (hosel) 15 extending obliquely upward.

Figure 7:
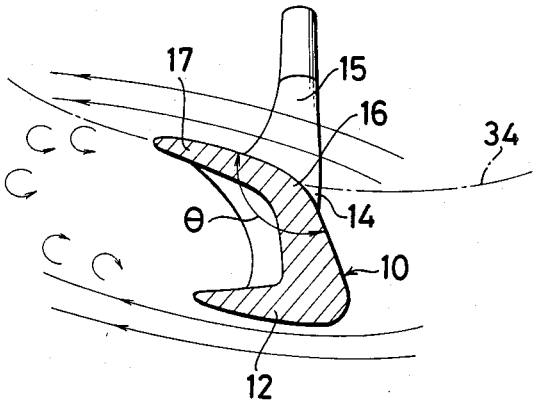
FIG. 7 is a vertical transverse sectional view taken on the in VII—VII of FIG. 3.
Figure 8:
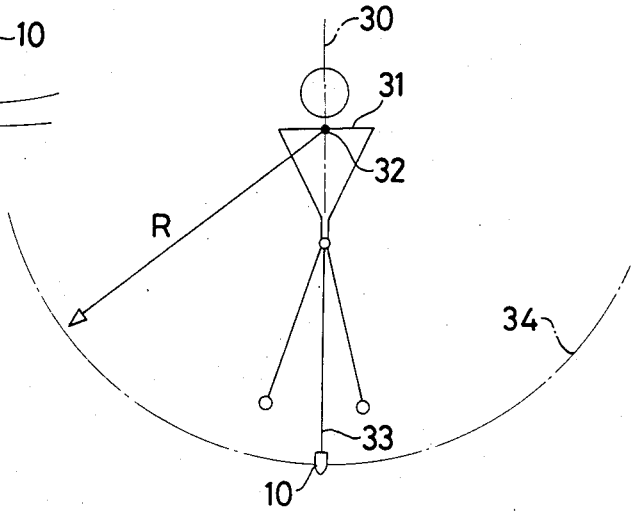
FIG. 8 is a diagram illustrating the operation of the present invention.
Figure 9:
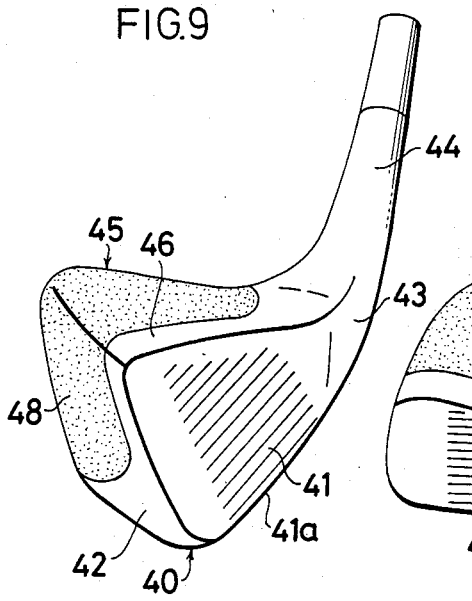
FIG. 9 is a perspective view of another form of an iron golf club head constructed in accordance with and embodying the present invention.
Figure 10:
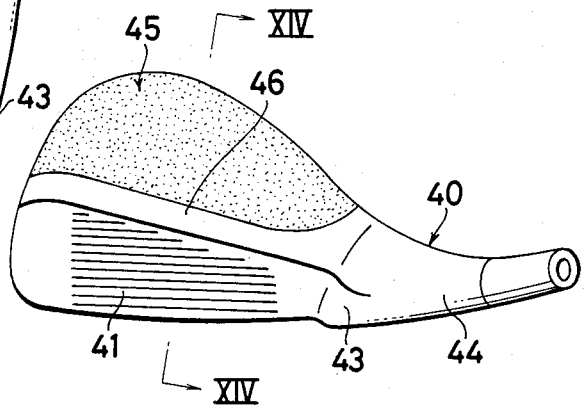
FIG. 10 is a plan view of the embodiment illustrated in FIG. 9.
Figure 11:
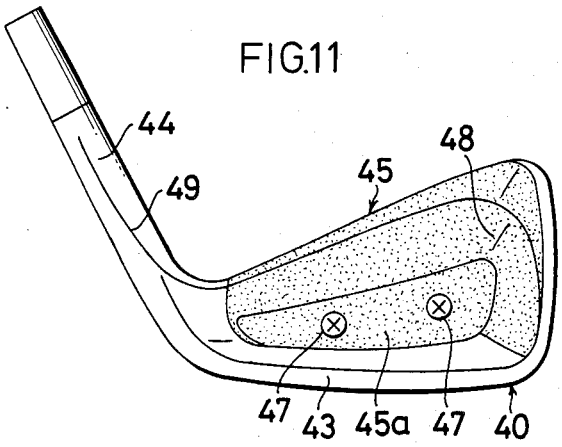
FIG. 11 is a rear view of the embodiment illustrated in FIG. 9.
Figure 12:
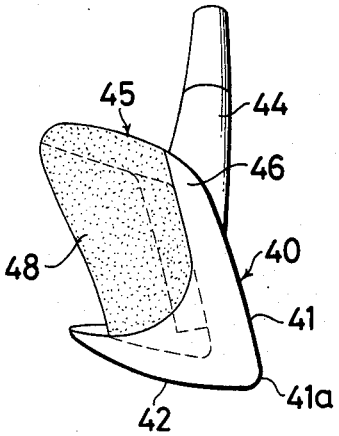
FIG. 12 is an end elevational view of the embodiment shown in FIG. 9 when viewed from the toe side.
Figure 13:
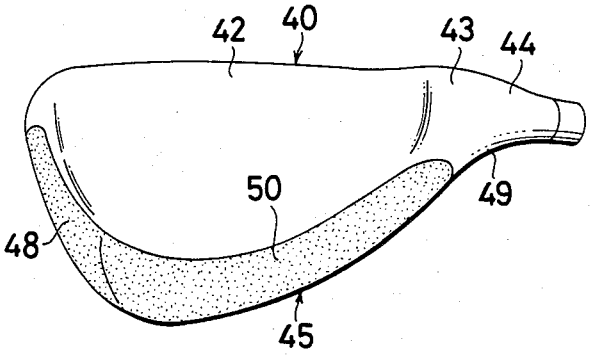
FIG. 13 is a bottom plan view of the embodiment illustrated in FIG. 9.

A top portion 16 of golf club head body 10 is formed integrally with a blade or upper wing 17 extending rearwardly from face portion 11. Said wing 17 serves to maintain the posture and direction of the head stable during the stroke downswing so that the golf club head body may not fluctuate under influence of air flow. With reference to FIGS. 7 and 8, wing 17 is arranged in such a state so as to coincide with the trajectory 34 during the downswing of golf club head 10 about the point of intersection 32 (FIG. 8) between the center axial line 30 of a golfer and the shoulder line 31 thereof; with a radius R being the sum of the arm's length and the length of an iron golf club 33. The angle $\theta$ formed between wing 17 and face portion 11 varies depending upon the particular loft angle (the angle of inclination of the face portion of the club). Said angle $\theta$ increases as the iron of the related club number increases from 1 to 9 and is changed to some degree depending upon the length of the shaft, height of the golfer, etc.

The side face of neck portion 15 is formed integrally with a wing portion 18 extending rearwardly of the club head body 10, being joined to wing 17, and expands toward the side of a coupling root portion of neck portion 15.

The back side of the thus configured golf club head body 10 defines a rearwardly opening hollow or recess 19 surrounded on four sides by sole portion 12, toe portion 13, heel portion 14 and wing 17.

With the iron golf club head of the foregoing configuration of this embodiment, wing-like sole portion 12 extending rearwardly of golf club head body 10, and wing 17 provided at the top portion 16 of said body 10, will coincide with the radial trajectory 34 of the downswing of the golf club head, with minimal disturbance in the laminar air flow passing along the outer surface of sole portion 12 and wing 17 during the downswing of the iron club. A turbulent flow, i.e. vortex flow, tending to exfoliate the laminar air flow develops only rearwardly of, and spacedly from, club head body 10, as shown in FIG. 7. Thus, the aerodynamic reaction on golf club head body 10 in response to generation of the vortex flow is largely decreased in comparison with a conventional head body. The speed of the head can be increased even by the exercise of a force less than that required by prior art structures. Fluctuation of the golf club head does not occur during the downswing as wing 17 serves to stabilize the direction of the swing of said head, and as a result, the posture and direction of the head becomes stable with respect to the ball, with the possibility of generation of a faulty or imperfect shot being reduced. Further, since the rearwardly extending toe portion 13 is provided on the side of the toe of golf club head body 10 and wing portion 18 is formed at neck portion 15, the aerodynamic reaction caused by toe portion 16 and neck portion 15 acting on golf club head is reduced with the influence of the air resistance of the club head being further improved.

The second embodiment of the present invention is illustrated in FIGS. 9 through 14 wherein reference numeral 40 indicates golf club head body integrally formed of metal, such as stainless steel, soft iron, brass or aluminum: and is composed of face portion 41 having an inclination corresponding to the loft angle relating to the particular iron club number, wing-like sole portion 42 extending rearwardly from a lower margin 41*a* of face portion 41, a heel portion 43 provided at the rearward end of face portion 41, and a neck portion (hosel) 44 extending obliquely upwardly from heel portion 43.

Figure 14:
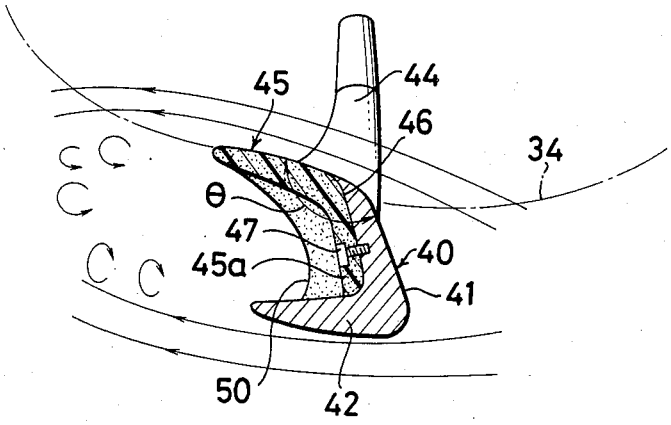
FIG. 14 is a vertical transverse sectional view taken on the line XIV—XIV of FIG. 10.

Reference numeral 45 designates a wing for maintaining the posture and direction of the head stable during the downswing so that the club head may not fluctuate under air flow influence. Wing 45 is integrally constructed of a synthetic resin, such as ABS or nylon, or metal, such as soft iron, stainless steel, or aluminum; and incorporates a mounting segment 45*a* for securement to the rearward face of top portion 46 of the club head body 40, as by suitable fasteners such as screws 47. Wing 45 in its secured state extends rearwardly of the golf club head body 40, and is arranged in such state so as to coincide with the trajectory 34 of the downswing of the club head about the point of intersection 32 between the center axial line 30 of the golfer and the shoulder line 31 thereof, with the radius R being equal to the sum of the arm's length of the golfer and the length of the iron golf club 33, as shown in FIGS. 14 and 8. The angle $\theta$ formed between wing 45 and face portion 41 varies depending upon the loft angle relating to the particular iron number (the angle of inclination of the face portion 41). Angle $\theta$ increases as the iron number increases from 1 to 9 and will be somewhat altered depending upon the length of the shaft, height of the golfer, etc.

The end portion of wing 45 opposite to neck portion 44 is formed integrally with a toe portion 48 of the golf club head body 40, which toe portion 48 extends rearwardly of the club head body 40 from the front margin of face portion 41. The side face of the neck portion 44 is formed integrally with a wing portion 49 extending rearwardly of the club head body 40 and expands toward the side of a coupling root portion of neck portion 44; being configured so as to control with wing 47.

The rearward side of club head body 40 thus defines a rearwardly opening hollow, or recess 50 surrounded on four sides by sole portion 42, heel portion 43, wing 45 and toe portion 48.

In the iron golf club head of the foregoing configuration of this embodiment, wing-like sole portion 42 extending rearwardly of golf club head body 40 and wing 45 provided at the top portion 47 of said body 40 will coincide with the radial trajectory 34 of the downswing of the golf club head with minimal disturbance in the laminar air flow passing along the outer surface of sole portion 42 and wing 45 during the downswing of the iron club. A turbulent flow, i.e. vortex flow, tending to exfoliate the laminar air flow develops only rearwardly of, and spacedly from, club head body 40, as shown in FIG. 14. Thus, the aerodynamic reaction on golf club head body 40 in response to generation of such vortex flow is greatly decreased in comparison with, or relative to that developed through use of a conventional head body. The speed of the head can be increased even by the exercise of a force less than that required by the prior art structures. Fluctuation of the golf club head does not occur during the downswing as wing 45 serves to stabilize the direction of the swing of said head and as a result, the posture and direction of the head becomes stable with respect to the ball, with the possibility of generation of a faulty or imperfect shot being reduced. Furthermore, since the rearwardly extending toe portion 48 is provided on the side of the toe of golf club head body 40 and wing portion 49 is formed at neck portion 44, the aerodynamic reaction caused by toe portion 48 and neck portion 44 and acting on the golf club head is reduced with the influence of the air resistance of the club head being further improved.

In addition, because wing 45 is made independently of the golf club head body 40, it is possible to adjust easily toe-heel balance and toe-sole balance of the head body 40 to a requisite state so as to accord with the conditions of the golfer by changing the material and/or thickness of the mounting segment 45*a* and toe portion 48.

As described hereinabove, according to the present invention, the top portion of the head body is provided with the wing extending rearwardly of the golf club head body and coincides with the radial trajectory of the downswing. Thus, it results therefrom that fluctuation of the golf club head does not occur during the downswing and the posture and direction of the head can be maintained stable with respect to the ball. In addition, with the wing being made independently of the golf club head body, the toe-heel balance and top-sole balance of the golf club head body can be adjusted easily by changing the material and/or thickness of the wing and toe portion provided on the former.

What is claimed is:

1. In a golf club iron, a club head including a body having a top portion, a sole portion, and a face portion, characterized by the top portion and sole portion being provided with respective upper and lower wings extending rearwardly from the face portion, said wings both being in coincidence with the radial trajectory of the head during the downswing of the club, said wings providing minimal disturbance in laminar air flow passing along outer surfaces of the wings for decreased aerodynamic reaction on the head body during downswing of the club.

2. In a golf club iron as defined in claim 1, said wings being integrally formed with said club head body.

3. In a golf club iron as defined in claim 1, said lower wing being integrally formed with said club head body to define said sole portion, said club head body having a rearward face, said upper wing being fabricated as a unit nonintegral with said club head body, and means for securing said upper wing to said rearward face.

4. In a golf club iron as defined in claim 3, there being a heel portion provided at an inner end of said face portion, said upper wing being formed integrally with a toe portion remote from said heel portion.

5. In a golf club iron as defined in claim 3, said upper wing being constructed of synthetic resin.

6. In a golf club iron as defined in claim 3, said upper wing being constructed of metal.

7. In a golf club head as defined in claim 1 wherein said lower wing is integrally formed with said club head body.

8. In a golf club head as defined in claim 1 wherein means are provided for detachably securing said upper wing to said body.

9. In a golf club head as defined in claim 1 wherein a toe portion extends rearwardly from the outer end of said face portion, said sole portion extending rearwardly from the lower end of said face portion, there being a heel portion provided at the inner end of said face portion and extending rearwardly therefrom to define said lower wing, a neck portion integrated with said heel portion, said body having a rearwardly opening recess defined between said wings.

* * * * *